US012559270B2

(12) United States Patent
Allapichai et al.

(10) Patent No.: US 12,559,270 B2
(45) Date of Patent: Feb. 24, 2026

(54) METHOD FOR PRODUCING A PACKAGING FROM A RECYCLABLE MATERIAL

(71) Applicant: SOCIETE DES PRODUITS NESTLE S.A., Vevey (CH)

(72) Inventors: Sheik Abdullah Allapichai, Lausanne (CH); Alexey Vishtal, Apples (CH); Julien Gaillard, Epalinges (CH)

(73) Assignee: Société des Produits Nestlé S.A., Vevey (CH)

( * ) Notice: Subject to any disclaimer, the term of this patent is extended or adjusted under 35 U.S.C. 154(b) by 280 days.

(21) Appl. No.: 18/246,732

(22) PCT Filed: Sep. 28, 2021

(86) PCT No.: PCT/EP2021/076642
§ 371 (c)(1),
(2) Date: Mar. 27, 2023

(87) PCT Pub. No.: WO2022/064058
PCT Pub. Date: Mar. 31, 2022

(65) Prior Publication Data

US 2023/0382575 A1 Nov. 30, 2023

(30) Foreign Application Priority Data

Sep. 28, 2020 (EP) ..... 20198593

(51) Int. Cl.
*B65B 9/08* (2012.01)
*B65B 9/06* (2012.01)
(Continued)

(52) U.S. Cl.
CPC ..... *B65B 9/08* (2013.01); *B65B 9/06* (2013.01); *B65B 9/20* (2013.01); *B65B 51/02* (2013.01);
(Continued)

(58) Field of Classification Search
CPC ..... B65B 9/08; B65B 9/087; B65B 9/093; B65B 51/02; B65B 51/30; B65D 65/14; B65D 65/466
See application file for complete search history.

(56) References Cited

U.S. PATENT DOCUMENTS 3,032,251 A * 5/1962 Jarund ..... B65D 75/50 229/116
3,145,907 A * 8/1964 Schwinger ..... B65D 33/22 383/107
(Continued)

FOREIGN PATENT DOCUMENTS

CN 209988165 1/2020
DE 202016106438 12/2016
(Continued)

*Primary Examiner* — Joshua G Kotis
(74) *Attorney, Agent, or Firm* — Thorpe North & Western, LLP

(57) ABSTRACT

The invention relates to a method for producing a packaging (200) for enclosing a substance (500). A flat sheet (100) made of recyclable paper material and having two opposite side edge sections (101, 102) is provided and formed into a tube (120) by folding the flat sheet (100) so that the two side edge sections (101, 102) overlap each other at an overlapping section (123). The tube (120) is heat sealed along the overlapping section (123) to form a longitudinal sealing joint (130) and heat sealed across the longitudinal sealing joint (130) to close the tube (120) with a first traverse sealing joint (141) at a first tube end (121). The tube (120) is filled with a substance (500) and heat sealed across the longitudinal sealing joint (130) to close the tube (120) with a second traverse sealing joint (142) at a second tube end (122). A first and second amount of glue (300-302) is applied onto the flat sheet (100) at a first and a second triple point section (151, 152) where the longitudinal sealing joint (130) and the respective traverse sealing joints (141, 142) intersect,
(Continued)

respectively. The glue (300-302) seals the respective triple point section (151, 152) upon heat sealing of the respective tube end (121, 122) to form the respective traverse sealing joint (141, 142). The invention also relates to a packaging (200) enclosing a substance (500) and a machine (600) for producing the packaging (200).

9 Claims, 5 Drawing Sheets

(51) Int. Cl.

| | |
|---|---|
| ***B65B 9/20*** | (2012.01) |
| ***B65B 51/02*** | (2006.01) |
| ***B65B 51/30*** | (2006.01) |
| ***B65D 65/46*** | (2006.01) |
| ***B65D 75/44*** | (2006.01) |
| *B65B 41/16* | (2006.01) |
| *B65B 61/06* | (2006.01) |

(52) U.S. Cl.
CPC ..... *B65B 51/30* (2013.01); *B65D 65/466* (2013.01); *B65D 75/44* (2013.01); *B65B 41/16* (2013.01); *B65B 61/06* (2013.01)

(56) References Cited

U.S. PATENT DOCUMENTS 3,543,468 A * 12/1970 Leasure ..... B65B 9/2035 53/552
4,035,984 A 7/1977 Gerlach et al.
4,079,662 A * 3/1978 Puccetti ..... B65B 51/303 493/203
4,721,242 A * 1/1988 Reil ..... B29C 66/1122 229/941
5,899,325 A * 5/1999 Bertram ..... B65B 9/213 53/450
11,548,238 B2 * 1/2023 Sanibondi ..... B29C 65/1658
2005/0069230 A1 * 3/2005 Takahashi ..... B65D 75/008 383/107
2006/0105124 A1 * 5/2006 Kikuchi ..... B29C 66/73921 428/35.2
2007/0131739 A1 * 6/2007 Ponti ..... B65D 75/46 229/87.01
2008/0171110 A1 7/2008 Stuart
2008/0173385 A1 * 7/2008 Ansinn ..... B29C 66/91218 156/379
2011/0154779 A1 * 6/2011 Baba ..... B65B 55/025 53/111 R
2012/0195527 A1 * 8/2012 Moehlenbrock ..... B65B 9/2028 493/227
2013/0209005 A1 * 8/2013 Owensby ..... B65B 43/04 383/210.1
2015/0020483 A1 * 1/2015 Di Fede ..... B65B 41/16 53/551
2015/0353218 A1 * 12/2015 Köhn ..... B65D 33/02 53/567
2018/0186087 A1 * 7/2018 Yuhara ..... B29C 66/346
2018/0222617 A1 * 8/2018 Yamamoto ..... B29C 65/7451
2019/0184649 A1 * 6/2019 Trejo ..... B29C 66/1122
2019/0344915 A1 11/2019 Persson
2020/0216204 A1 * 7/2020 Ricco' ..... B29C 66/723
2021/0129451 A1 * 5/2021 Ferris ..... B65D 75/008
2022/0002017 A1 * 1/2022 Morikawa ..... B65B 51/225

FOREIGN PATENT DOCUMENTS

| | | |
|---|---|---|
| JP | H01213123 | 8/1989 |
| JP | 2003020028 | 1/2003 |
| JP | 2005102819 | 4/2005 |
| JP | 2018053400 | 4/2018 |
| WO | 2005035367 | 4/2005 |
| WO | 2013177634 | 12/2013 |

* cited by examiner

METHOD FOR PRODUCING A PACKAGING FROM A RECYCLABLE MATERIAL

CROSS REFERENCE TO RELATED APPLICATIONS

The present application is a National Stage of International Application No. PCT/EP2021/076642, filed on Sep. 28, 2021, which claims priority to European Patent Application No. 20198593.4, filed on Sep. 28, 2020, the entire contents of which are being incorporated herein by reference.

1. FIELD OF THE INVENTION

The present invention relates to a method for producing a packaging by providing a flat sheet, folding the flat sheet into a tube, filling the tube with a substance and heat sealing sections of the tube to enclose the substance inside the packaging. The invention further relates to a packaging enclosing a substance and a machine for producing this packaging.

2. TECHNICAL BACKGROUND

Commonly, a majority of single- and multi-serve packaging, e.g. used for coffee beans, are made from plastic materials due to their beneficial characteristics. For example, these materials offer advantages, such as durability, flexibility, low weight, provision of long shelf-life and letting the taste of the enclosed product unaltered. Additionally, a packaging can be manufactured from such materials efficiently and reliably. Unfortunately, reusing and recycling such packaging materials is challenging.

Thus, several approaches have been undertaken to replace such established materials with alternative materials that facilitate and simplify recycling of the packaging after its use. For example, paper-based materials are proposed as alternative packaging materials as they can be recycled more easily compared to plastic materials.

However, a disadvantage of such alternative materials is that they do not have the same or very different material properties as established materials, like plastic or aluminium. For example, packages made from alternative materials often have a limited shelf-life as they do not provide the same oxygen and moisture barrier as aluminium or plastic. Moreover, different production methods are required as alternative materials also differ from known materials in material characteristics that are relevant for forming and sealing a packaging.

For example, it is possible to provide a stick pack or a sachet packaging from established materials such that the content inside the respective package is hermetically sealed. Thereby, the risk of biological degradation from bacterial contamination, oxidation or moisture can be reduced. In comparison, the provision of a stick pack or sachet packaging made from a paper material does not allow to seal the packaging reliably and consistently.

In particular, the bending stiffness and deformation resistance of the paper material impedes a reliable sealing of the packaging in places, where, for example, more than two layers of paper material are joined or where sealing lines intersect. Moreover, the paper material must have a relatively high thickness in comparison to the dimensions relating to bending radius and joining sections of the packaging to provide sufficient tearing strength. Therefore, the different layers are prone to spring back into their original position or peel off directly after a joining attempt. This leads to gaps, holes or voids within the designated sealing lines so that it is not possible to provide a hermetically sealed packaging with paper based materials. This is particularly disadvantageous for packaging intended to be used for foodstuff or pharmaceutical products.

As a possible solution to overcome this problem, it is considered to add more sealant or adhesive onto the paper material before or during sealed. However, this is not an option as paper material can be recycled only if it contains only a limited amount of adhesives or sealants. Thus, it is evident that this approach does not overcome the problems that exist already with presently used, established materials. As an alternative solution, it is considered to provide special packaging production machinery, which requires special equipment to establish high joining forces to be exerted over long periods of time. However, this leads to an increase of production and manufacturing costs due to the new design of completely new production machinery and success is uncertain.

Therefore, it is an object of the present invention to provide a method for producing a packaging from a recyclable paper material that hermetically seals the packaging, that is fully recyclable, and that facilitates that existing machinery can be used for producing said packaging after simple or minor modifications.

These and other objects, which become apparent upon reading the description, are solved by the subject-matter of the independent claims. The dependent claims refer to preferred embodiments of the invention.

3. SUMMARY OF THE INVENTION

A first aspect of the invention relates to a method for producing a packaging for enclosing a substance. The method comprises the step of providing a flat sheet made of a recyclable paper material, which has two opposite side edge sections.

Therein, the expression "flat sheet" may be understood as a portion of paper that may be thin in comparison to its length and may have at least one even surface, for instance.

The expression "recyclable" may be understood, for example, as a material that can be reused entirely for a new product or purpose after having been treated mechanically or chemically using an industrial or natural process. For example, the paper material used in the invention may be collected after usage and may be mixed with water and chemicals to break it down. It is heated up and broken up into strands of cellulose.

Plastic coatings and ink may be removed as long as they do not exceed a certain amount, for example by filtering. Therein, to recycle the paper material successfully, the amount of a plastic coating on the recycled material or the amount of polymer content in the recyclable material may only be up to about 20%, preferably up to about 15%, more preferably up to about 10%, and most preferably up to about 5%, of its total weight.

The flat sheet is formed into a tube by folding the flat sheet so that the two side edge sections at least partially overlap each other at an overlapping section. The tube is heat sealed along the overlapping section to form a longitudinal sealing joint. Further, the tube is heat sealed across the longitudinal sealing joint to close the tube with a first traverse sealing joint at a first tube end. The tube is filled with a substance to be packed.

Therein, the expression "substance" may be understood, for example, as any type of solid, liquid, at least partially soluble and/or percolate-able matter, which may have a particular or definite chemical constitution. Examples for substances may be cosmetic, medical or food products, such as cereals, roasted ground coffee, instant coffee, coffee mixes, creamer, tealeaves, chocolate or dairy products, or dehydrated edible substances.

The tube is heat sealed across the longitudinal sealing joint to close the tube with a second traverse sealing joint at a second tube end opposite to the first tube end with respect to the substance to be packed such that the packaging enclosing said substance is formed. A first amount of glue is applied onto the flat sheet at a first triple point section. At the first triple point section, the longitudinal sealing joint and the first traverse sealing joint intersect. A second amount of glue is applied onto the flat sheet at a second triple point section. At the second triple point section, the longitudinal sealing joint and the second traverse sealing joint intersect. The glue seals the respective triple point section upon heat sealing of the respective tube end to form the respective traverse sealing joint.

Therein, the expression "glue" may be understood, for example, as any substance that may be applied to surfaces of portions between which a (structural/permanent/temporary) bond is to be established.

In other words: the present invention provides a method that facilitates the production of a packaging that not only (hermetically) sealingly encases, wraps or covers the substance to be packed but that can be recycled easily and efficiently after being used.

Therefore, the method stipulates to provide an even, thin in comparison to its length portion of paper-based material that has two side edge sections opposite to each other. Therein, a side edge section may be understood as any part or portion of the flat sheet that extends from one of the two opposite side edges towards the other side edge, for example. The method provides further to fold the flat sheet into a tube by folding the flat sheet such that the two side edge sections at least partially overlap. Thus, the two side edge sections may be arranged in the folded state such that they may extend over each other such that they may both cover a portion of the tube, which may be the overlapping section. Therein, it is also conceivable that one of the side edge sections may project/overhang the other one in the folded state. Thus, while not being excluded, it is not required for the two side edges to be arranged flush with each other. In the overlapping section, the side edge sections may face each other with the same side of the flat sheet. Preferably, the overlapping section can be formed such that it protrudes from the packaging. Preferably, the overlapping section can be formed such that both side edge sections or the overlapping section are positioned at an outer side of the packaging.

The tube is then to be sealed lengthwise by heat sealing. Thus, in this instance, the sealing direction may comprise at least one component corresponding with the longitudinal axis of the tube. During heat sealing, heat and pressure may be applied to influence the material of the surfaces to be sealed. The two ends of the tube are heat sealed across the longitudinal sealing joint with traverse sealing joints, respectively. Therein, the traverse sealing joints may run in an oblique or winded manner relative to the longitudinal sealing joint so that it is not necessary (while not being excluded at the same time) that the traverse sealing joints are orthogonal to the longitudinal sealing joint. Thereby, it is possible to enclose/encase/wrap the substance, which is filled into the packaging, from all sides. Naturally, there is no limitation on the number of traverse and longitudinal sealing joints as well as on the number of triple point sections. An amount, such as a (defined) quantity, mass or volume, of glue is put (dispensed/spread) onto the triple point sections, at which the longitudinal sealing joint and the respective traverse sealing joint cross each other, respectively.

Thereby, it is possible to provide glue directly and only on places that require additional adhesive or sealant in order to achieve reliable sealing and closing of the packaging.

Thereby, it is possible to overcome the problems relating to adhesive failure, where the adhesive itself does not establish a strong enough bond with the substrate. Thus, with this targeted and precise glue application, it is possible to keep the amount of glue on the packaging at very low levels so that it still can be recycled. Additionally, it is possible to apply this method almost independently from the details of the design of a packaging to a wide range of different packaging applications and material combinations. Hence, the method of the invention overcomes the aforementioned problems of the prior art.

According to a preferred embodiment, the respective amount of glue may be applied before the step of forming the flat sheet into the tube. Preferably, the first amount of glue and/or the second amount of glue may be applied as a spot of glue.

Thereby, it is possible to apply and to dose the glue precisely and accurately. Moreover, it is possible to assure that the glue remains in its dosed shape and intended position so that problems arising from smearing the glue can be avoided. Thereby, the sealing accuracy and reliability can be improved.

According to a further preferred embodiment, the glue may be a structural adhesive that may harden via processes such as evaporation of a solvent, reaction with UV radiation, chemical reactions, or adapting its temperature. Additionally or alternatively, the glue may be a pressure-sensitive adhesive to form a bond by applying a certain amount of pressure to bind the adhesive to the surface to be joined. For example, the glue may (be configured to) change from a liquid state, in which the glue may be flowable, to a solid state, in which the glue may be dry. The physical state of the glue may depend on the temperature and/or pressure. For example, the glue may melt at a temperature between 50 degree Celsius and 220 degree Celsius, preferably between 90 degree Celsius and 180 degree Celsius. The glue may be a hotmelt glue, for instance.

Preferably, the glue may be dry before the step of forming the flat sheet into the tube or at least before the step of heat sealing the tube to form the longitudinal sealing joint. The dried glue may be reactivated upon the respective heat sealing step by melting the glue such that the glue is flowable and seals the respective triple point section after drying. Preferably, the glue may seal the respective triple point section such that the longitudinal sealing joint as well as the first and second traverse sealing joints form a hermetic sealing of the packaging. Therein, the expression "hermetic sealing" may be understood, for example, as a gas-proof sealing.

The expression "dry" may be understood, for example, as the glue having changed from a liquid and/or flowable state to a hardened state. Preferably, in the hardened state at least the outside contour of the glue may be solid. Alternatively or additionally, in the hardened state the glue may have solidified entirely. Preferably, the glue may be only or more capable of bonding in a liquid state. However, this is only an example. The expression "flowable" may be understood, for example, as the characteristic of a viscous liquid or paste to move or spread freely without being intensely limited or restricted by intermolecular forces. Furthermore, the expression "reactivated" may be understood, for example, as changing the capabilities of the glue from a state, in which no new bonding(s) can be formed, to a state, in which the glue is capable of forming new (intermolecular/surface) bonds.

Thereby, it is possible to improve the process of sealing the packaging at the triple point sections as the glue can be re-melted when arriving in the desired sealing position.

Additionally, the production process of the packaging can be improved because the glue can be applied in a liquid state from a gluing pistol and then can be dried so that subsequent process steps are not affected by the glue being wet, which may be disadvantageous, for example, when folding the flat sheet. Thus, it is possible to use and refit already existing equipment of the prior art to produce the packaging of the invention so that production costs can be kept low.

Preferably, the glue may be a recyclable, incinerable, biodegradable and/or compostable material. Therein, the expression "biodegradable material" may be understood as any material that can be broken down into environmentally innocuous products by (the action of) living things (such as microorganisms, e.g. bacteria, fungi or algae). Examples for suitable glue substances may be polyvinyl alcohol (PVOH), ethylene vinyl alcohol (EVOH), polyvinyl acetate (PVAc), wax, polyolefins (PO) and/or acrylic components. For instance, the glue may be a PO-based or an acrylic-based hotmelt adhesive or glue.

Thereby, it is possible to recycle and compost the packaging after it being used. Also, using such packaging can reduce the ecological impact of single use packaging.

According to a preferred embodiment, the flat sheet material may comprise a laminated and/or multi-layered structure with a base layer made of a paper material and a sealant layer. Therein, the glue may be (directly) applied onto the sealant layer. The flat sheet may have various (layer) configurations, forms and shapes.

Therein, the expression "laminated/layered structure" may be understood, for example, as a structure comprising different parts that are arranged in plies, slats, tiers or as strata. Therein, it is possible to provide the flat sheet with an arbitrary number of layers that each can provide a desired functionality, such as, for example, a layer for sealing, (a further layer) for forming a (moisture/oxygen) barrier, and/or for providing a sealant or adhesive (such as, for example, said sealant layer).

Thereby, it is possible to tailor the material characteristics of the flat sheet to the needs of the respective application. Moreover, the production process of the packaging can be improved as the packaging can be produced with refitted already existing and accessible production equipment.

According to a further preferred embodiment, the step of providing the flat sheet may comprise the step of unrolling a longitudinal flat sheet material from a paper reel. Preferably, the step of providing the flat sheet may further comprise the step of longitudinally cutting the flat sheet material into separate flat sheets, of which each has the two opposite side edge sections. A plurality of packages may be formed in series. Therein, neighbouring packages may share a transverse sealing joint that forms the first traverse sealing joint of one of the packages and the second traverse sealing joint of the neighbouring package. Alternatively or additionally, the first amount of glue of one of two neighbouring packages may be provided together with the second amount of glue of its neighbouring package. Preferably, the step of heat sealing the tube to form the second traverse sealing joint may be followed by a step of separating the packages. Preferably, the separating may be completed by a transverse cutting step. Alternatively, the step of heat sealing the tube to form the second traverse sealing joint may be followed by a step of weakening a connection section, which preferably may be the shared transverse sealing joint, to form a tear line.

Thereby, it is possible to increase the production rate and quality of the packages.

A further aspect of the present invention relates to a packaging being made of a flat sheet with two opposite side edge sections and made of a recyclable paper material. The packaging encloses a substance.

Therein, the expression "enclose" may be understood, for example, as surrounding, covering, wrapping and/or encasing something, such as the substance, preferably in a sealing manner.

The packaging comprises a longitudinal sealing joint along an overlapping section, at which the two opposite side edge sections overlap each other when the flat sheet is folded to form the flat sheet into a tube. The packaging further comprises a first traverse sealing joint, which extends across the longitudinal sealing joint to close the tube at a first tube end. The packaging also comprises a second traverse sealing joint, which extends across the longitudinal sealing joint to close the tube at a second tube end opposite to the first tube end with respect to the enclosed substance. The packaging comprises a first amount of glue that seals a first triple point section, at which the longitudinal sealing joint and the first traverse sealing joint intersect, and a second amount of glue that seals a second triple point section, at which the longitudinal sealing joint and the second traverse sealing joint intersect.

Thereby, it is possible to provide a packaging that not only sealingly encases the substance to be packed but that can be recycled easily and efficiently after being used.

According to a preferred embodiment, the flat sheet may comprise a multi-layered structure comprising a base layer made of a paper material and a sealant layer. Preferably, the sealant layer may be provided on at least one of the two opposite side surfaces of the flat sheet. Alternatively or additionally, the sealant layer may be provided as a coating or a laminate that acts as a sealant during heat sealing.

Thereby, it is possible to tailor the material characteristics of the packaging to the needs of the respective application as layers can provide different functionalities such as sealing properties or being water resistant.

Preferably, the base layer may have a thickness of at least 50 microns (microns=micrometres), preferably at least 60 microns. Preferably, the thickness of the base layer may be up to 120 microns. For example, the base layer may have a thickness between at least 50 microns and (at most) 120 microns. Alternatively or additionally, the sealant layer may have a thickness of 5-10 microns, preferably 6-8 microns.

Thereby, it is possible to provide a stable packaging that offers a sufficient tearing resistance while limiting the amount of sealant to minimum levels. In particular, it is possible to provide a paper-based material with a (in comparison to the paper-based material) relatively thin sealant layer. Thus, with the above configuration the physical properties and quality of the packaging can be improved.

According to a further preferred embodiment, the packaging may be a single serve pack like a stick pack, or a multi-serve pack like a stand-up pouch, a pillow pack, and/or a gusseted bag. Preferably, in the overlapping section the side edge sections may face each other with the same side of the flat sheet. Preferably, the overlapping section may be formed such that it protrudes from the packaging or such that both side edge sections or the overlapping section are positioned at an outer side of the packaging. Preferably, the packaging may be configured to seal hermetically an enclosed food product as the substance.

Thereby, it is possible to improve the manufacturing process of the packaging as filling can be completed almost instantaneously with the sealing process. Thereby, it can be achieved that the substance has a lower exposure time to the surroundings and thus, a filled packaging with this configuration can offer an improvement of product shelf-life.

Naturally, the packaging may comprise all aforementioned features or characteristics that are described above for the method according to the first aspect of the invention. For reasons of brevity, explicit reiteration of these features is omitted at this juncture.

A further aspect of the present invention relates to a machine for producing a packaging for enclosing a substance as described in detail above.

The machine comprises a feeding system for supplying a flat sheet made of a recyclable paper material and having two opposite side edge sections. The machine further comprises a folding section for folding the supplied flat sheet so that the two opposite side edge sections overlap each other at an overlapping section to form the flat sheet into a tube. The machine comprises a first heat sealing section for heat sealing the tube along the overlapping section to form a longitudinal sealing joint. Further, the machine comprises a second heat sealing section for heat sealing the tube across the longitudinal sealing joint to close the tube with a first traverse sealing joint at a first tube end. Also, the machine comprises a filling section for filling the tube with a substance to be packed. Moreover, the machine comprises a third heat sealing section for heat sealing the tube across the longitudinal sealing joint to close the tube with a second traverse sealing joint at a second tube end opposite to the first tube end with respect to the substance to be packed so as to form the packaging enclosing said substance.

The machine is characterized by further comprising a glue application section. The glue application section is suitable (and/or configured) for applying a first amount of glue onto the flat sheet at a first triple point section, at which the longitudinal sealing joint and the first traverse sealing joint will intersect, so that the glue seals the first triple point section upon the heat sealing of the tube at the second heat sealing section to form the first traverse sealing joint. The glue application section is further suitable (and/or configured) for applying a second amount of glue onto the flat sheet at a second triple point section, at which the longitudinal sealing joint and the second traverse sealing joint will intersect, so that the glue seals the second triple point section upon the heat sealing of the tube at the third heat sealing section to form the second traverse sealing joint. Preferably, the second and third heat sealing sections may be identical or integral.

Thereby, it is possible to provide a machine that produces a packaging that not only (hermetically) sealingly encases the substance to be packed but that can be recycled easily and efficiently after being used. In particular, the machine is capable of providing glue to such a reduced amount to the starting material that it is possible to maintain the sealant/adhesive content to a level that facilitates recycling of the produced packaging. Therein, the application of glue in the machine is to be conducted in the described manner, which allows that glue is only applied in places that require additional sealant/adhesive during heat sealing.

According to a preferred embodiment, the glue application section may be arranged in the machine such that the glue is dry before arriving at any one of the folding section and the first to third heat sealing sections. Preferably, the machine may be configured (adapted) to complete any or all of the above described steps of the method of the first aspect of the invention.

Thereby, it is possible to apply the glue such that the glue maintains its intended shape and does not interfere with subsequent production steps completed by the machine.

Thereby, this configuration facilitates an improvement of the production process with simple and cost-effective means.

According to a further preferred embodiment, the feeding system may comprise a reel feeding system for unrolling a longitudinal flat sheet material from a paper reel to supply the flat sheet. Further, the machine may preferably further comprise a cutting section for separating a plurality of packages formed in series. Preferably, the third heat sealing section may be configured to transport the flat sheet from the feeding system to the cutting section preferably by gripping and pulling the second tube end.

Thereby, it is possible to produce the packaging with high speed and in a fully automated process as well as without undue costs for reconfiguring or refitting already existing machines in accordance with the configuration of the machine of the invention.

4. BRIEF DESCRIPTION OF DRAWINGS

Further features, advantages and objects of the invention will become apparent for the skilled person when reading the following detailed description of embodiments of the invention and when taking in conjunction with the figures of the enclosed drawings.

In case numerals have been omitted from a figure, for example for reasons of clarity, the corresponding features may still be present in the figure.

DETAILED DESCRIPTION

Figure 3:
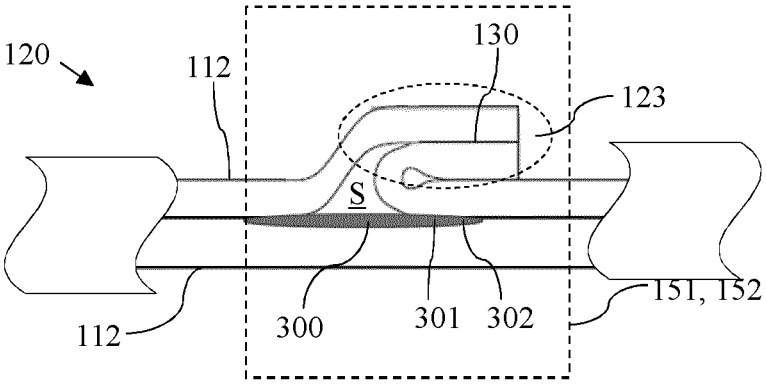
FIG. 3 shows an enlarged schematic side view cut-out of an end of the tube of FIG. 2.
Figure 4:
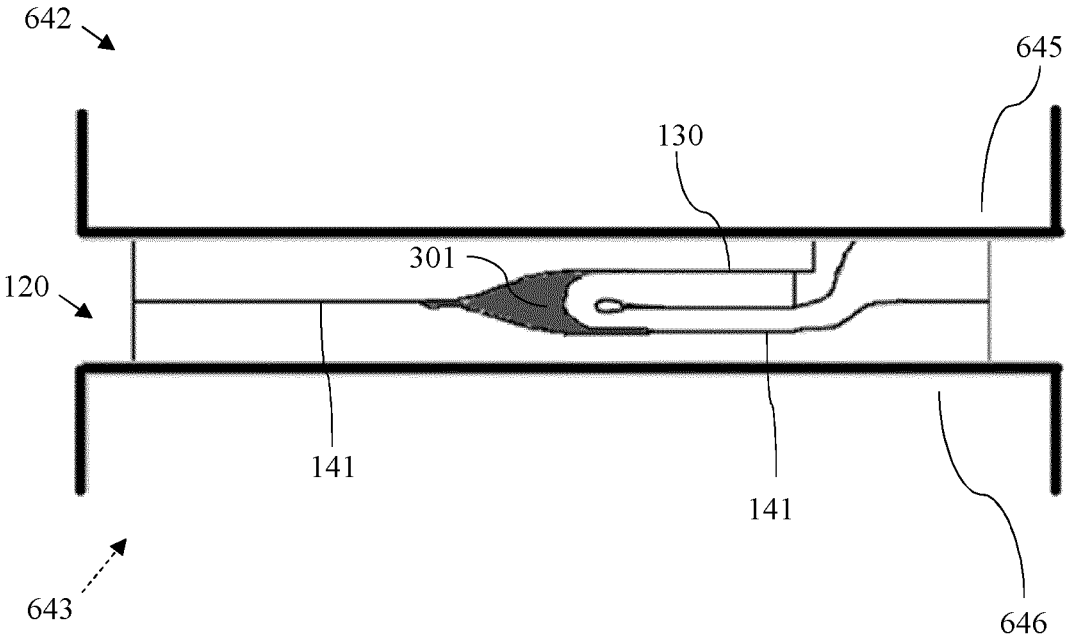
FIG. 4 shows a schematic side view of the tube of FIG. 2 during the heat-sealing process.
Figure 5:
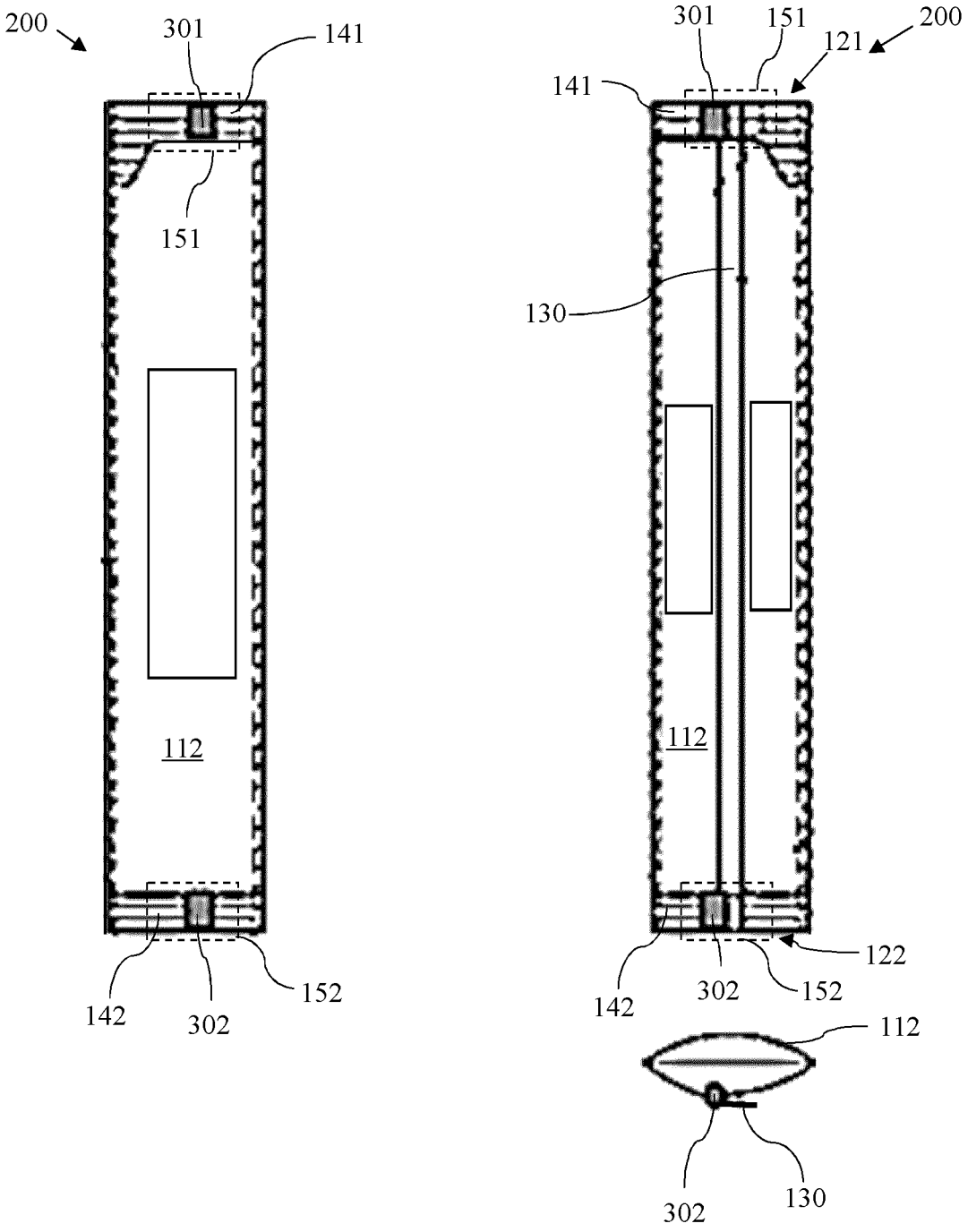
FIG. 5 shows a schematic front, rear and side view of the packaging according to the present invention.
Figure 6:
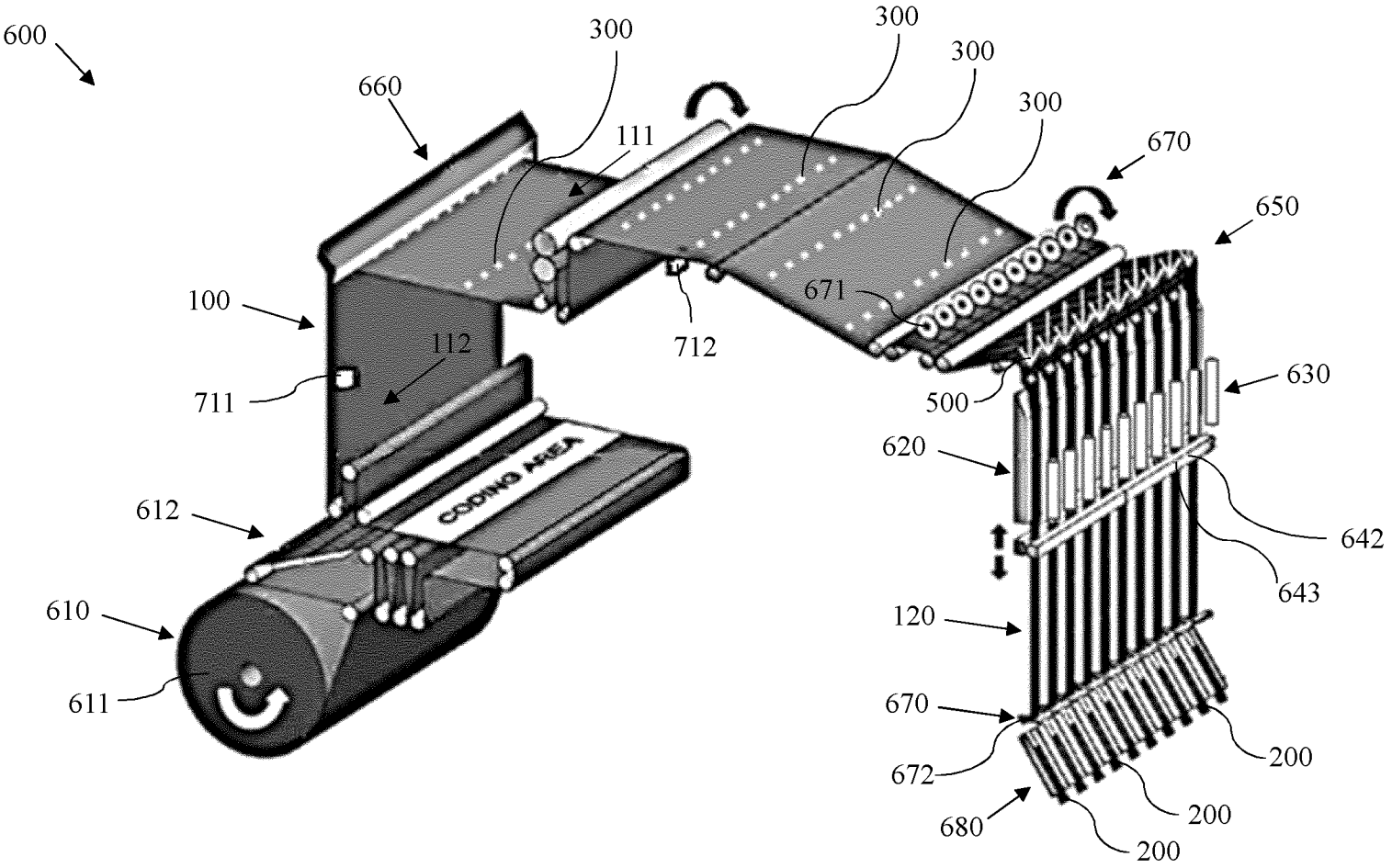
FIG. 6 shows a machine for producing a packaging according to the present invention.
Figure 7:
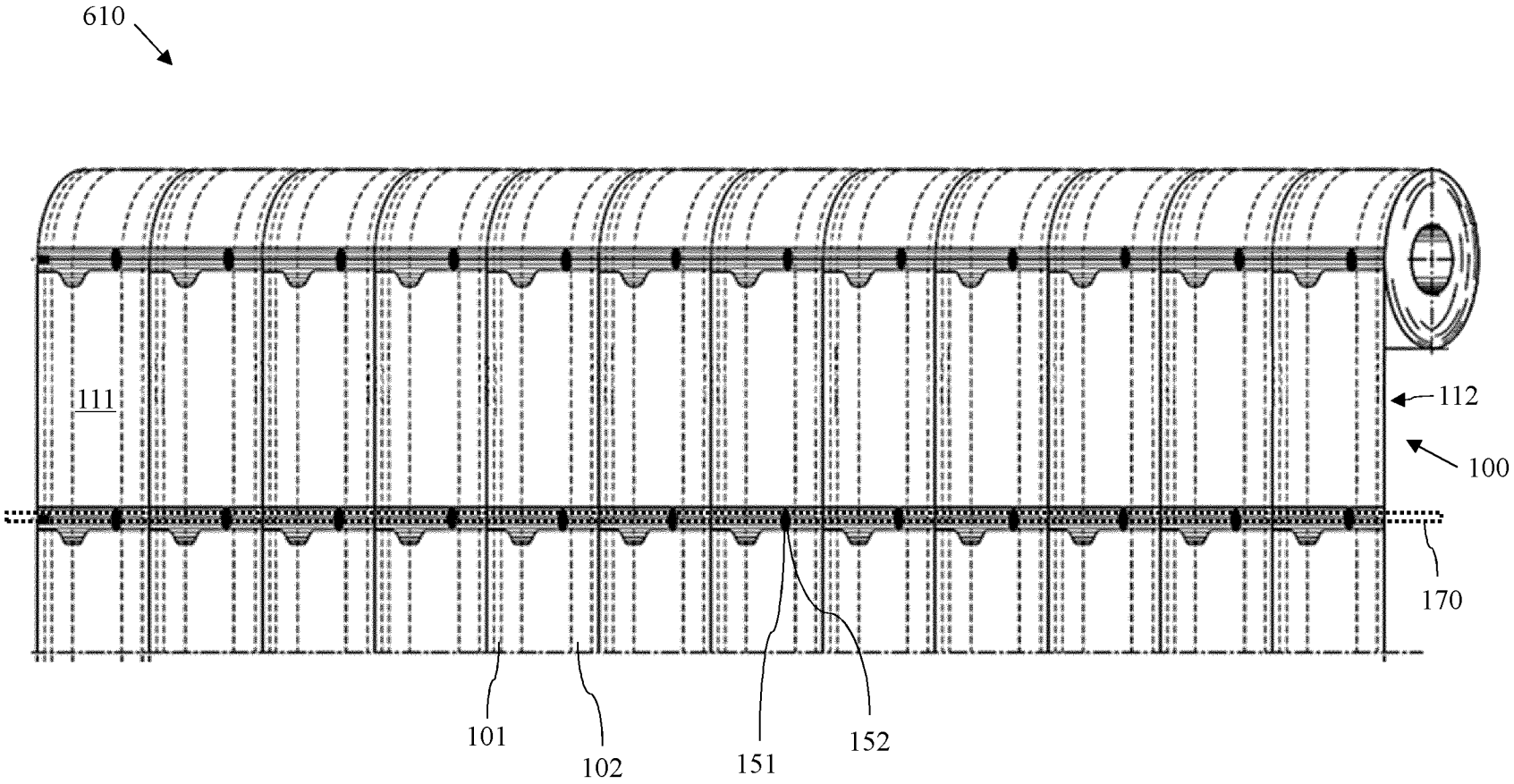
FIG. 7 shows a detailed view of geometric dimensions and ratios of the flat sheet used in the machine of FIG. 6 for the packaging of FIG. 5.

The figures show different views and aspects of the present invention. For example, FIGS. 1 to 4 illustrate some of the steps of a method for producing a packaging 200 according to the present invention. FIG. 5 shows aspects of the packaging 200 according to the present invention. FIGS. 6 and 7 exemplarily illustrate aspects of a machine 600 for producing the packaging 200 in accordance with the present invention.

The method for producing the packaging 200 for enclosing a substance 500 comprises a step of providing a flat sheet 100 made of a recyclable paper material and having two opposite side edge sections 101, 102. The side edge sections 101, 102 may extend from a respective side edge of the flat sheet 100 towards the opposite side edge section 101, 102, respectively. The two side edge section 101, 102 may form together the complete side surface of the flat sheet 100. Preferably, the flat sheet 100 may also have two opposite side surfaces 111, 112. The flat sheet 100 may have any shape or form. For example, the flat sheet may have a (substantially) quadratic or rectangular form, such as exemplarily illustrated in FIG. 1. However, this is not a complete enumeration.

In general, for example, the flat sheet material may comprise paper (e.g. (exclusively or at least primarily) made of cellulose fibres, such as cellulose fibres derived from wood, grass, and/or bamboo) as well as further (arbitrary) components that may or may not be recyclable or biodegradable. Therein, the further components, which may, for example, be a plastic coating or other polymer content, would be limited to a quantity of up to about 20%, preferably up to about 15%, more preferably up to about 10%, and most preferably up to about 5%, of the total weight of the (entire) flat sheet material (so to render the flat sheet material still recyclable). While the further components may be provided as layers, laminates on the paper material, it is also conceivable that the further components may be mixed or blended into the paper material itself. However, these are only examples and do not represent a complete enumeration.

The flat sheet material may comprise a laminated and/or multi-layered structure. Therein, the flat sheet 100 (or the flat sheet material) may comprise a base layer and a sealant layer (not shown). It is also conceivable that the flat sheet material may comprise additional layers, which preferably may or may not be of a recyclable, biodegradable and/or compostable material. Preferably, the base layer may be made of a paper material.

The base layer may have a grammage between 40 $g/m^2$ and 120 $g/m^2$, preferably between 50 $g/m^2$ and 80 $g/m^2$. As abbreviation for the unit of the grammage may be used the expression "gsm" meaning "grams per square meter". Examples for suitable recyclable paper material may be machine glazed paper or metallized paper. For example, the machine glazed paper may be a paper without any coating and one side thereof may have a smooth surface while the side opposite thereto may have a rough surface. Metallized paper may be a paper coated with a layer of metal, such as aluminium, whereby preferably the coating may be applied by lamination or vacuum metallization.

The sealant layer may have a thickness of 5 to 10 microns, preferably 6 to 8 microns. Examples for materials to be used as a sealant layer may be a polyolefin dispersion or an acrylic coating. The sealant layer may have a grammage between 1 $g/m^2$ and 15 $g/m^2$, preferably between 4 $g/m^2$ and 10 $g/m^2$. The sealant layer may be configured to melt by applying temperatures onto the flat sheet 100 in the range of 150 degree Celsius to 220 degree Celsius. Alternatively or additionally, the sealant layer may change its physical state or binding characteristics under pressure or exposure with (UV) radiation. Preferably, the sealant layer may be provided on at least one of the two opposite side surfaces 111, 112 of the flat sheet 100. The sealant layer may be a coating that acts as a sealant in a heat-sealing process.

Preferably, the flat sheet 100 may be provided by unrolling a longitudinal flat sheet material. For example, the flat sheet 100 may be unrolled from a paper reel 611 arranged in the machine 600. Alternatively or additionally, the flat sheet 100 may be provided such that a wide longitudinal flat sheet material may be unrolled, longitudinally cut (e.g. by circular knifes) into separate flat sheets 100 such that the so separated flat sheet 100 has the two opposite side edge sections 101, 102, respectively. This is exemplarily shown in FIGS. 6 and 7.

Figure 1:
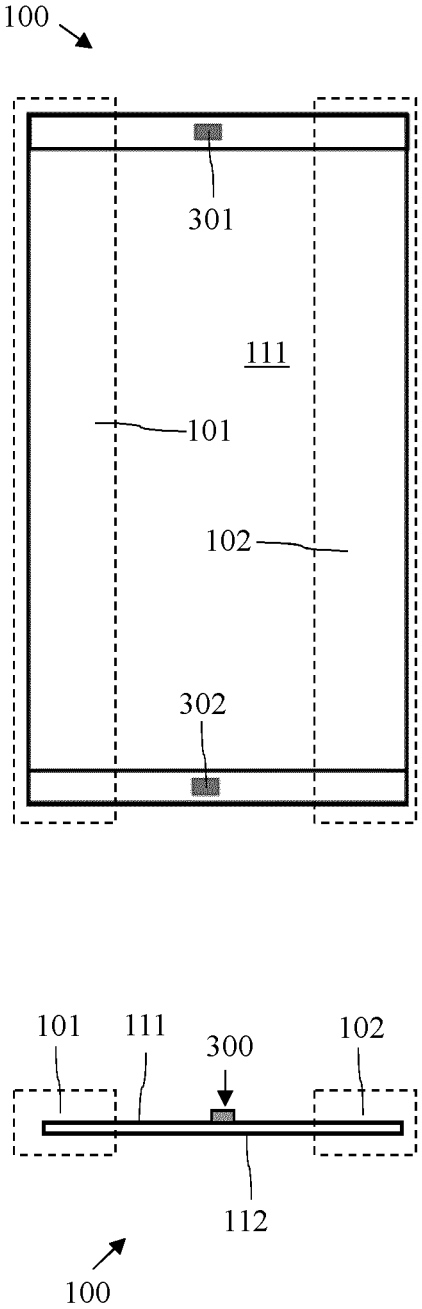
FIG. 1 shows a schematic front and side view of a flat sheet used in the method of the present invention and for the packaging of the present invention.
Figure 2:
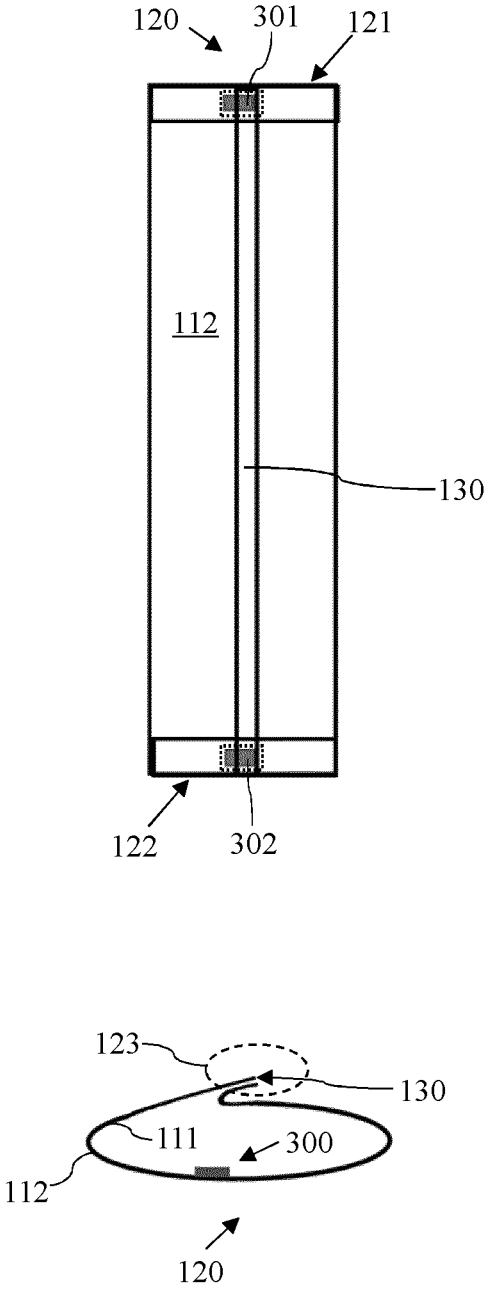
FIG. 2 shows a schematic front and side view of the flat sheet of FIG. 1 after being folded into a tube configuration.

The flat sheet 100 is formed into a tube 120 by folding the flat sheet 100 so that the two side edge sections 101, 102 at least partially overlap each other at an overlapping section 123. In the overlapping section 123, the side edge sections 101, 102 may face each other with the same side of the flat sheet 100. Thus, the two side edge sections 101, 102 may be folded such that they come to rest on each other with the same side of the flat sheet 100. This is exemplarily shown in FIGS. 2 to 4, where the two side edge sections 101, 102 face each other with a first side surface 111. The tube 120 is heat sealed along the overlapping section 123 to form a longitudinal sealing joint 130. FIGS. 2 and 3 show this exemplarily. Preferably, the tube 120 may have a first tube end 121 and a second tube end 122, between which preferably the longitudinal sealing joint 130 may at least partially, preferably fully, extend. FIGS. 2 and 5 show this exemplarily.

The (sealed) overlapping section 123 may be formed such that it protrudes from the packaging 200, preferably in the sealed state. The (sealed) overlapping section 123 may also be formed such that it protrudes from the packaging 200 or such that both side edge sections 101, 102 or the overlapping section 123 are positioned at an outer side of the packaging 200. FIGS. 2 and 5 show this exemplarily.

The tube 120 is heat sealed across the longitudinal sealing joint 130 to close the tube 120 with a first traverse sealing joint 141 at the first tube end 121 (e.g. shown in FIG. 5). To achieve this, a second heat sealing section 642 may be provided that may comprise two heat sealing jaws 645, 646 that are arranged opposite to each other. FIG. 4 shows an exemplary embodiment for the second heat sealing section 642. The two heat sealing jaws 645, 646 may be (linearly and/or rotationally) movable to each other. The heat sealing jaws 645, 646 may be moved between a treatment state, where the tube 120 may be pressed between the two heat sealing jaws 645, 646 to apply a binding force (e.g. between 500 N to 1500 N), a pressure (e.g. between 2 bar and 10 bar) and/or heat (temperature between 150 degree Celsius to 220 degree Celsius) to the tube 120 for a certain amount of time (e.g. between 0.1 to 10 seconds). The heat sealing jaws 645, 646 may be moved to a release state, where the tube 120 may be movable between (released from) the two heat sealing jaws 645, 646. In FIG. 4, the provision of the first traverse sealing joint 141 is exemplarily depicted, whereby the heat sealing jaws 645, 646 are exemplarily shown in the treatment state. Therein, it is conceivable that both of the heat sealing jaws 645, 646 may be movable or only one of the two heat sealing jaws 645, 646 may be movable.

Similarly, the tube 120 is heat sealed across the longitudinal sealing joint 130 to close the tube 120 with a second traverse sealing joint 142 at the second tube end 122, which is opposite to the first tube end 121 with respect to the substance 500 to be packed. This is not explicitly illustrated in the Figures. However, the provision of the second traverse sealing joint 142 may be conducted similarly (or in (exactly) the same way) as exemplarily illustrated in FIG. 4. Therein, a third heat sealing section 643 may be provided that may have a similar or identical configuration as the aforementioned second heat sealing section 642 (e.g. as illustrated in FIG. 4). However, it is also conceivable that the same device is used for heat sealing the first traverse sealing joint 141 and the second traverse sealing joint 142. Thus, the second and third heat sealing section 642, 643 may be identical/the same device. Furthermore, it is also conceivable that the second heat sealing section 642 may be integral with the third heat sealing section 643. This is exemplarily illustrated in FIG. 4, where the third heat sealing section 643 is indicated by an arrow with a broken line as the third heat sealing section 643 may be hidden behind the second heat sealing section 642 (when seen in side view). In addition, it is also conceivable that one of the heat sealing jaws 645, 646 may form the second heat sealing section 642 while the respective other of the two heat sealing jaws 645, 646 may form the third heat sealing section 643. However, these are only examples and different configurations are possible.

By providing the second traverse sealing joint 142, the packaging 200 is formed such that it encloses the packed substance 500.

It is also conceivable that the longitudinal sealing joint 130 may be sealed onto the tube 120, preferably the first or second traverse sealing joint 141, 142, in a heat-sealing step such that it is fixed thereto. FIG. 3 may be suitable for indicating such a possible configuration exemplarily.

At some point in the process, the tube 120 is filled with the substance 500 to be packed. The substance 500 may be a food product or a medicine product.

The method further comprises a step of applying a first amount of glue 301 onto the flat sheet 100 at a first triple point section 151. At the first triple point section 151, the longitudinal sealing joint 130 and the first traverse sealing joint 141 intersect. This is exemplarily illustrated in FIGS. 2, 3 and 5.

The method also comprises a step of applying a second amount of glue 302 onto the flat sheet 100 at a second triple point section 152. At the second triple point section 152, the longitudinal sealing joint 130 and the second traverse sealing joint 142 intersect. This is exemplarily illustrated in FIGS. 2, 3 and 5.

The first amount of glue 301 and/or the second amount of glue 302 may be applied as a spot of glue 300. This is exemplarily illustrated in FIGS. 1 to 6. Preferably, any of the glue 300-302 may be applied onto the sealant layer. For example, in FIGS. 1 to 7 the sealant layer may be provided on the first side surface in of the flat sheet 100, which may form an inner surface of the tube 120 after the folding step. In the following description, the denomination "glue" may comprise each of the glue 300 to 302.

The glue 300-302 seals the respective triple point section 151, 152 upon the heat sealing of the respective tube end 121, 122 to form the respective traverse sealing joint 141, 142. This is exemplarily illustrated in FIGS. 4 and 5.

It is also conceivable that the respective amount of glue 300-302 may be applied before the step of forming the flat sheet 100 into the tube 120. This is illustrated in FIGS. 1 to 3, 6 and 7.

Preferably, the glue 300-302 may be dry before the step of forming the flat sheet 100 into the tube 120 or before the step of heat sealing the tube 120 to form the longitudinal sealing joint 130. Thus, the glue 300-302 may change from a solid state, in which the glue 300-302 is dry, to a liquid state, in which the glue 300-302 is flowable. The change of the physical state of the glue 300-302 may be activated by changing the temperature and/or pressure around the glue 300-302. Therein, the (dried) glue 300-302 may (be configured to) be reactivated upon the respective heat-sealing step by melting the glue 300-302 such that the glue 300-302 is flowable and seals the respective triple point section 151, 152 after drying. This is exemplarily illustrated in FIGS. 3 and 4.

For example, FIG. 3 shows exemplarily the tube 120 being mechanically pressed (e.g. by/between the two heat sealing jaws 645, 646) at the first tube end 121 before heat sealing of the first traverse sealing joint 141. In this configuration, the glue 301 may have been applied onto the first surface in inside the tube 120, the glue 301 may be positioned (as a spot) (directly) below the longitudinal sealing joint 130 and may be in a dry state. FIG. 3 illustrates that a space S may be formed between the overlapping section 123 and the pressed together mantle portions of the tube 120. As exemplarily illustrated in FIG. 4, by heat sealing the first tube end 121 to form the first traverse sealing joint 141, a rise in temperature and/or pressure may be effected such that the glue 301 may be melted and may flow into the space S. Thereby, the space S may be filled and sealed by the glue 301. The same may be found for the second traverse sealing joint 142 with the second amount of glue 302. Therein, for each of the cases, the respective amount of glue 301, 302 may be provided (/exist) as the spot of glue 300. Thus, the glue 300-302 may (be configured to) seal the respective triple point section 151, 152 such that the longitudinal sealing joint 130 as well as the first and second traverse sealing joints 141, 142 may form (together) a hermetic sealing of the packaging 200.

Thus, the size, thickness, shape, and/or position of the first and second amount of glue 301, 302 may influence, for example, the reliability of the sealing of the packaging 200. FIG. 7 shows examples for suitable positions for the glue application, which are indicated by filled circles and may correspond with the triple point sections 151, 152. Similarly, the shape and/or configuration of the sealing jaws 645, 646 may influence, for example, the melting directions and/or melting behaviour of the glue 300-302.

Examples for suitable materials for the glue 300-302 may be wax or any polyolefin (PO)-based or acrylic-based hot-melt glue or adhesive.

A plurality of packages 200 may be formed in series. This is exemplarily illustrated in FIGS. 6 and 7. Thereby, neighbouring packages 200 may share a shared transverse sealing joint that may form the first traverse sealing joint 141 of one of the packages 200 and the second traverse sealing joint 142 of the neighbouring package 200. Also, the first amount of glue 301 of one of two neighbouring packages 200 may be provided together with the second amount of glue 302 of its neighbouring package 200. The method may conclude the process of manufacturing the packaging 200 by separating the packages 200 by a transverse cutting step. This is exemplarily shown in FIG. 6, where a cutting section 670 with a horizontal cutter 672 may be provided. Alternatively, the process of manufacturing the packaging 200 may be concluded by weakening a connection section 170 to form a tear line. FIG. 7 indicates exemplarily that the shared transverse sealing joint may be provided (or planned) as the connection section 170.

A further aspect of the present invention relates to the packaging 200. FIG. 5 shows an example for the packaging 200. The packaging 200 may be a single serve pack like a stick pack, or a multi-serve pack like a stand-up pouch (e.g. Doypack), a pillow pack, or a gusseted bag. The packaging 200 may be suitable for enclosing food products.

The packaging 200 is made of the aforementioned flat sheet 100 with the two opposite side edge sections 101, 102 and made of a recyclable paper material. The packaging 200 encloses the substance 500 and comprises the longitudinal sealing joint 130. As described in detail above, the longitudinal sealing joint 130 runs along the overlapping section 123, at which the two opposite side edge sections 101, 102 overlap each other when the flat sheet 100 is folded to form the tube 120. This is exemplarily illustrated in FIG. 5. The first traverse sealing joint 141 extends across the longitudinal sealing joint 130 to close the tube 120 at the first tube end 121. The second traverse sealing joint 142 extends across the longitudinal sealing joint 130 to close the tube 120 at the second tube end 122. In the packaging 200, the first amount of glue 301 seals the aforementioned first triple point section 151 and the second amount of glue 302 seals the aforementioned second triple point section 152. Preferably, the packaging 200 may be configured such that it (hermetically) seals an enclosed food product as the substance 500. Preferably, the glue 301, 302 may seal the traverse sealing joints 141, 142 at a position that may be laterally offset from a longitudinal axis and/or the longitudinal sealing joint 130. However, it is also conceivable that the glue 301, 302 may be found in the middle of the traverse sealing joints 141, 142, respectively.

FIG. 7 shows exemplarily the unprocessed flat sheet 100 with geometrical dimensions and ratios of folding and sealing lines that may be found in the finished packaging 200.

A further aspect of the invention is directed to the machine 600 for producing the aforementioned packaging 200. An example for the machine 600 is shown in FIG. 6.

The machine 600 comprises a feeding system 610 for supplying the flat sheet 100. The feeding system 610 may comprise a reel feeding system 612 for unrolling a longitudinal flat sheet material from the abovementioned paper reel 611 to supply the flat sheet 100. Therein, the reel feeding system 612 may comprise a buffer section for keeping a sufficient amount of sheet material available for processing. This is exemplarily shown in FIG. 6.

The machine 600 further comprises a folding section 620 for folding the supplied flat sheet 100 so that the two opposite side edge sections 101, 102 overlap each other at the overlapping section 123 to form the flat sheet 100 into the tube 120. The folding section 620 may be configured to fold the sheet 100 into the tube 120 and/or to position/hold the tube 120 such that the glue 300-302 is positioned below the longitudinal sealing joint 130. Also, the folding section 620 may define the diameter of the tube 120 and the size of the overlapping section 123.

The machine 600 further comprises a filling section 650 for filling the tube 120 with the substance 500 to be packed. The substance 500 is exemplarily illustrated as white arrows in FIG. 6. The folding section 620 and the filling section 650 may be a single unit and may be a form plate, for example. The machine 600 may be a horizontal (HFFS) or a vertical form fill seal (VFFS) machine such as the machine 600 shown in FIG. 6.

The machine 600 also comprises a first heat sealing section 630 for heat sealing the tube 120 along the overlapping section 123 to form the longitudinal sealing joint 130. The first heat sealing section 630 may be a vertical heat sealer.

Furthermore, the machine 600 comprises the aforementioned second heat sealing section 642 for heat sealing the tube 120 across the longitudinal sealing joint 130 to close the tube 120 with the first traverse sealing joint 141 at the first tube end 121. An example for the second heat sealing section 642 may be found in FIGS. 4 and 6. Preferably, the second heat sealing section 642 may be a horizontal heat sealer. The aforementioned third heat sealing section 643 is arranged on the machine 600 for heat sealing the tube 120 across the longitudinal sealing joint 130 to close the tube 120 with the second traverse sealing joint 142 at the second tube end 122 to enclose the substance 500. Preferably, the third heat sealing section 643 may be a horizontal heat sealer.

The second and third heat sealing sections 642, 643 may be identical. This is exemplarily shown in FIG. 6, where the second heat sealing section 642 and the third heat sealing section 643 are not only integral with each other but also form the same component. Preferably, in the second and third heat sealing section 642, 643 the glue 300-302 may be reactivated.

The machine 600 further comprises a glue application section 660 for applying the first amount of glue 301 onto the flat sheet 100 at the first triple point section 151 to seal the first triple point section 151 upon the heat sealing of the tube 120 at the second heat sealing section 642 to form the first traverse sealing joint 141 and for applying the second amount of glue 302 onto the flat sheet 100 at the second triple point section 152 to seal the second triple point section 152 upon the heat sealing of the tube 120 at the third heat sealing section 643 to form the second traverse sealing joint 142.

The glue application section 660 may be arranged in the machine 600 such that the glue 300-302 is dry before arriving at any one of the folding section 620 and the first to third heat sealing sections 630, 642, 643. This is exemplarily shown in FIG. 6, where a defined distance is set between the glue application section 660 and the folding section 620. For example, the spots of glue 300, which are illustrated in FIG. 6 leaving the glue application section 660 may be wet spots of glue 300 while the subsequent four lines of spots of glue 300 closer to the folding section 620 may be (already) dried/hardened spots of glue 300. The glue 300 may be dried also by using additional means, such as a cooler or a fan (not illustrated).

The machine 600 may further comprise a cutting section 670 for separating a plurality of packages 200 formed in series before releasing the packages in an exit system 680. The exit system 680 may be a chute. The cutting section 670 may comprise the abovementioned horizontal cutter 672. Moreover, the cutting section 670 may comprise a longitudinal cutter 671 for cutting a wide flat sheet material into multiple separate flat sheets 100. The longitudinal cutter 671 may be one or more circular knifes.

Furthermore, the second heat sealing section 642 and/or the third heat sealing section 643 may be configured to transport the flat sheet 100 from the feeding system 610 to the cutting section 670 by gripping and pulling the second tube end 122. This is exemplarily illustrated in FIG. 6.

Moreover, the machine 600 may further comprise two sensor units 711, 712 for controlling and monitoring the production process. The sensor units 711, 712 may be optical sensors, like a photocell or laser-based sensor. The sensor units 711, 712 may be connected to a control unit that may be configured to automatically complete the steps of the method for producing the packaging 200 according to the invention.

The invention is not limited by the embodiments as described hereinabove, as long as being covered by the appended claims. All the features of the embodiments described hereinabove can be combined in any possible way and be provided interchangeably.

The invention claimed is:

1. A method for producing a packaging for enclosing a substance, comprising:

providing a flat sheet made of a recyclable paper material comprising a base layer made of a paper material and a sealant layer and having two opposite side edge sections, wherein the sealant layer is provided on at least one of two opposite side surfaces of the flat sheet as a coating or a laminate that acts as a sealant during heat sealing, forming the flat sheet into a tube by folding the flat sheet so that the two side edge sections at least partially overlap each other at an overlapping section, heat sealing the tube along the overlapping section to form a longitudinal sealing joint, heat sealing the tube across the longitudinal sealing joint to close the tube with a first traverse sealing joint at a first tube end, filling the tube with a substance to be packed, heat sealing the tube across the longitudinal sealing joint to close the tube with a second traverse sealing joint at a second tube end opposite to the first tube end with respect to the substance to be packed so as to form the packaging enclosing said substance, the method further comprises applying glue only to triple point sections of the flat sheet by:

applying a first spot of glue onto the flat sheet at a first triple point section at which the longitudinal sealing joint and the first traverse sealing joint intersect, applying a second spot of glue onto the flat sheet at a second triple point section at which the longitudinal sealing joint and the second traverse sealing joint intersect, and wherein the first and second spots of glue seal the respective first and second triple point sections upon the heat sealing of the respective tube end to form the respective traverse sealing joint.

2. The method according to claim 1, wherein the first and second spots of glue are applied before the step of forming the flat sheet into the tube.

3. The method according to claim 1, wherein the glue is dry before the step of forming the flat sheet into the tube or at least before the step of heat sealing the tube to form the longitudinal sealing joint, and wherein the dried glue is reactivated upon the respective heat sealing step by melting the glue such that the glue is flowable and seals the respective triple point section after drying.

4. The method according to claim 3, wherein the glue seals the respective triple point section such that the longitudinal sealing joint as well as the first and second traverse sealing joints form a hermetic sealing of the packaging.

5. The method according to claim 1, wherein the glue is selected from the group consisting of wax, polyolefin (PO)-based and acrylic-based hotmelt adhesive.

6. The method according to claim 1, wherein the step of providing the flat sheet comprises a step of unrolling a longitudinal flat sheet material from a paper reel.

7. The method according to claim 6, wherein the step of providing the flat sheet further comprises longitudinally cutting the flat sheet material into separate flat sheets each having the two opposite side edge sections.

8. The method according to claim 1, wherein a plurality of packages is formed in series, wherein neighbouring packages share a transverse sealing joint forming the first traverse sealing joint of one of the packages and the second traverse sealing joint of the neighbouring package, and the first spot of glue of one of two neighbouring packages is provided together with the second spot of glue of its neighbouring package as a combined spot of glue.

9. The method according to claim 8, wherein the step of heat sealing the tube to form the second traverse sealing joint is followed by a step of separating the packages.

* * * * *